US007978155B2

(12) United States Patent
Yang et al.

(10) Patent No.: US 7,978,155 B2
(45) Date of Patent: Jul. 12, 2011

(54) PLASMA DISPLAY DEVICE AND DRIVING METHOD THEREOF

(75) Inventors: Jin-Ho Yang, Yongin-si (KR); Kwang-Ho Jin, Yongin-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 730 days.

(21) Appl. No.: 11/750,965

(22) Filed: May 18, 2007

(65) Prior Publication Data

US 2008/0106496 A1 May 8, 2008

(30) Foreign Application Priority Data

Nov. 7, 2006 (KR) ..... 10-2006-0109575

(51) Int. Cl.
*G09G 3/28* (2006.01)

(52) U.S. Cl. ..... 345/63

(58) Field of Classification Search ..... 345/35, 345/41, 60–69; 315/169.4
See application file for complete search history.

(56) References Cited

U.S. PATENT DOCUMENTS

| | | | | |
|---|---|---|---|---|
| 2001/0054994 | A1* | 12/2001 | Hsu et al. | 345/60 |
| 2005/0024294 | A1* | 2/2005 | Kim et al. | 345/60 |
| 2005/0110710 | A1* | 5/2005 | Lee et al. | 345/60 |
| 2005/0219153 | A1* | 10/2005 | Kim et al. | 345/60 |
| 2006/0007063 | A1* | 1/2006 | Ito et al. | 345/60 |
| 2006/0038749 | A1* | 2/2006 | Lee et al. | 345/60 |

FOREIGN PATENT DOCUMENTS

| | | | |
|---|---|---|---|
| CN | 1713265 | A | 12/2005 |
| CN | 1722202 | A | 1/2006 |
| CN | 1750068 | A | 3/2006 |
| EP | 0 261 584 | A2 | 3/1988 |
| EP | 1 662 465 | A2 | 5/2006 |
| JP | 2000-259110 | | 9/2000 |
| JP | 2002-149107 | | 5/2002 |
| JP | 2002-278509 | | 9/2002 |
| JP | 2004-354826 | | 12/2004 |
| JP | 2005-37604 | | 2/2005 |
| JP | 2005-316133 | | 11/2005 |
| KR | 10-2005-0122780 | | 12/2005 |
| KR | 10-0555071 | | 2/2006 |
| KR | 10-2007-0019622 | | 2/2007 |
| KR | 10-0708797 | | 4/2007 |

* cited by examiner

*Primary Examiner* — Chanh Nguyen
*Assistant Examiner* — Allison Walthall
(74) *Attorney, Agent, or Firm* — Christie, Parker & Hale, LLP

(57) ABSTRACT

A plasma display device includes: a sustain drive unit that applies a sustain pulse having a first voltage and a second voltage lower than the first voltage to a plurality of first electrodes; a scan drive unit including a plurality of selection circuits coupled to the first electrodes and each including first and second switches; and a clamping unit including a clamping diode coupled to at least one of the selection circuits and clamps the voltage of the first electrode at the first voltage when it exceeds the first voltage. The plasma display device can prevent overshoot that can occur when the first voltage of the sustain pulse is applied to the first electrode in a sustain period so as to apply a stable discharge pulse. The magnitude of the overshoot may depend on the distance between the scan driving board and each of the plurality of selection circuits IC.

13 Claims, 9 Drawing Sheets

PRIOR ART

PRIOR ART

PRIOR ART

PLASMA DISPLAY DEVICE AND DRIVING METHOD THEREOF

CROSS-REFERENCE TO RELATED APPLICATION

This application claims priority to and the benefit of Korean Patent Application No. 10-2006-0109575 filed in the Korean Intellectual Property Office on Nov. 7, 2006, the entire content of which is incorporated herein by reference.

BACKGROUND OF THE INVENTION

1. Field of the Invention

The present invention relates to a plasma display device and a driving method thereof.

2. Description of the Related Art

A plasma display device is a flat panel display device that displays characters or images using plasma generated by gas discharge, and includes more than several hundreds of thousands to millions of discharge cells arranged in a matrix.

According to a method of driving the plasma display device, a frame is divided into a plurality of subfields, each having a reset period, an address period, and a sustain period according to variation in the operation over time.

In the reset period, the status of each cell is initialized so as to facilitate an addressing operation on the cell. In the address period, in order to select turn-on cells and turn-off cells, address voltages are applied to the turn-on cells (addressed cells) to accumulate wall charges. In the sustain period, sustain pulses are applied to the addressed cells to actually perform image display.

Generally, in the sustain period of the plasma display device, sustain pulses alternately having a high level voltage (in general, a Vs voltage) and a low level voltage (in general, 0 V) and having polarities opposite to each other are applied to scan electrodes and sustain electrodes, causing sustain discharge of discharge cells. In this case, a capacitive component formed by the sustain electrode and the scan electrode can be modeled as a panel capacitor Cp.

FIG. 1 is a schematic circuit diagram illustrating a driving circuit of a conventional scan electrode driver, and FIG. 2 is a block diagram schematically illustrating a scan electrode driving board and scan boards connected to the scan electrode driving board. FIG. 3 is a diagram schematically illustrating a sustain pulse applied to a scan electrode by the scan electrode driving unit shown in FIG. 1.

As shown in FIG. 1, a scan electrode driver 400' includes a sustain drive unit 410, a reset drive unit 420, and a scan drive unit 430.

The sustain drive unit 410 includes a power recovery section 411 and sustain discharge switches Ys and Yg for forming a sustain discharge path. The switch Ys is connected between a power supply terminal Vs for supplying a Vs voltage and a scan electrode Y of a panel capacitor Cp, and the switch Yg is connected between a ground terminal for supplying a voltage of 0 V and the scan electrode Y of the panel capacitor Cp. The Vs voltage applied from the power supply terminal Vs through the switch Ys and the voltage of 0 V applied from the ground terminal GND through the switch Yg are alternately applied to the panel capacitor Cp.

During the sustain period, the sustain pulse is applied to the scan electrode Y of the panel capacitor Cp through each of a plurality of selection circuits 431 of the scan drive unit 430 by the operation of the switches Ys and Yg. In general, the plurality of selection circuits 431 are positioned in the form of integrated circuits IC (IC1 to IC12) on the scan boards 120 as shown in FIG. 2 and are connected to the panel capacitors Cp. Therefore, the sustain pulse actually applied to each panel capacitor Cp is affected by inductance depending on the distance between the sustain drive unit 410 positioned on the scan electrode driving board 110 and an output terminal of each of the selection circuits 431 (IC (IC1 to IC12)) positioned on the scan board 120. As a result, the sustain pulses applied through the selection circuits 431 (IC (IC1, IC2, IC11, and IC12)) furthest from the sustain drive unit 410 may overshoot as represented by a waveform C in FIG. 3. Further, the sustain pulses applied through the selection circuits 431 (IC3 to IC10) closer to the sustain drive unit 410 may overshoot as represented by a waveform A or a waveform B in FIG. 3.

As described above, when the voltages of the sustain pulses applied to the panel capacitors Cp are different from each other due to the difference in the distance between the sustain drive unit 410 and each selection circuit 431 (IC), a phenomenon may occur in which the upper and lower portions of the entire screen of the plasma display panel become brighter and the middle portion thereof becomes darker. Also, a phenomenon may occur in which the border lines between the portions of the screen corresponding to the selection circuits 431 (IC) are noticeable.

The above information disclosed in this Background section is only for enhancement of understanding of the background of the present invention and therefore it may contain information that does not form the prior art that is already known in this country to a person of ordinary skill in the art.

SUMMARY OF THE PRESENT INVENTION

Exemplary embodiments of the present invention include a plasma display device and a driving method thereof having a feature of applying stable sustain pulse voltages to all discharge cells.

An exemplary embodiment of the present invention is a plasma display device having a plurality of first electrodes and a plurality of second electrodes for performing a display operation together with the plurality of first electrodes, and the plurality of first electrodes and the plurality of second electrodes corresponding to a plurality of discharge cells defined in the plasma display device. The plasma display device includes a scan drive unit that includes a plurality of selection circuits each having a first switch and a second switch, the selection circuits being adapted to sequentially apply a scan voltage to some of the plurality of first electrodes through the first switches, and to apply a non-scan voltage to others of the plurality of first electrodes through the second switches; a sustain drive unit for applying a sustain pulse alternately having a first voltage and a second voltage lower than the first voltage to the plurality of first electrodes through the plurality of selection circuits; and a clamping unit coupled to at least one of the plurality of selection circuits and for clamping a voltage of a corresponding said first electrode at the first voltage when the voltage of the corresponding first electrode exceeds the first voltage. The clamping unit may include a clamping diode, for example.

Another exemplary embodiment of the present invention is a plasma display device which includes: a plurality of first electrodes; a first switch electrically coupled between the plurality of first electrodes and a first power supply for supplying a first voltage so as to form a path for applying the first voltage to the plurality of first electrodes; a second switch electrically coupled between the plurality of first electrodes and a second power supply for supplying a second voltage lower than the first voltage so as to form a path for applying the second voltage to the plurality of first electrodes; a plurality of third switches having input terminals electrically coupled to a contact point between the first and second switches and output terminals coupled to the plurality of first electrodes; and a clamping diode having an anode coupled to the input terminal of at least one of the plurality of third switches and a cathode coupled to the first power supply. In this plasma display device, the first and second voltages are applied to the plurality of first electrodes through the third switches.

Yet another exemplary embodiment of the present invention is a method of driving a plasma display device during a frame having a plurality of subfields each comprising a reset period, an address period and a sustain period. The plasma display device includes a plurality of first electrodes, a plurality of second electrodes crossing the plurality of first electrodes, and a scan drive unit for sequentially applying a scan voltage to the plurality of first electrodes, the plurality of first electrodes and the plurality of second electrodes corresponding to a plurality of discharge cells defined in the plasma display device. The driving method includes: sequentially applying the scan voltage to the plurality of first electrodes using the scan drive unit and applying an address voltage to the second electrodes of turn-on discharge cells of the discharge cells to which the scan voltage is applied in the ad dress period so as to select discharge cells among the plurality of discharge cells; and applying a sustain pulse having a first voltage and a second voltage lower than the first voltage to the plurality of first electrodes using the scan drive unit in the sustain period so as to cause sustain discharge in the selected discharge cells. In this driving method, in the sustain period, when an overvoltage is applied to at least one of the plurality of first electrodes, a voltage of said at least one of the first electrodes is clamped at the first voltage.

DETAILED DESCRIPTION OF THE EMBODIMENTS

Figure 1:
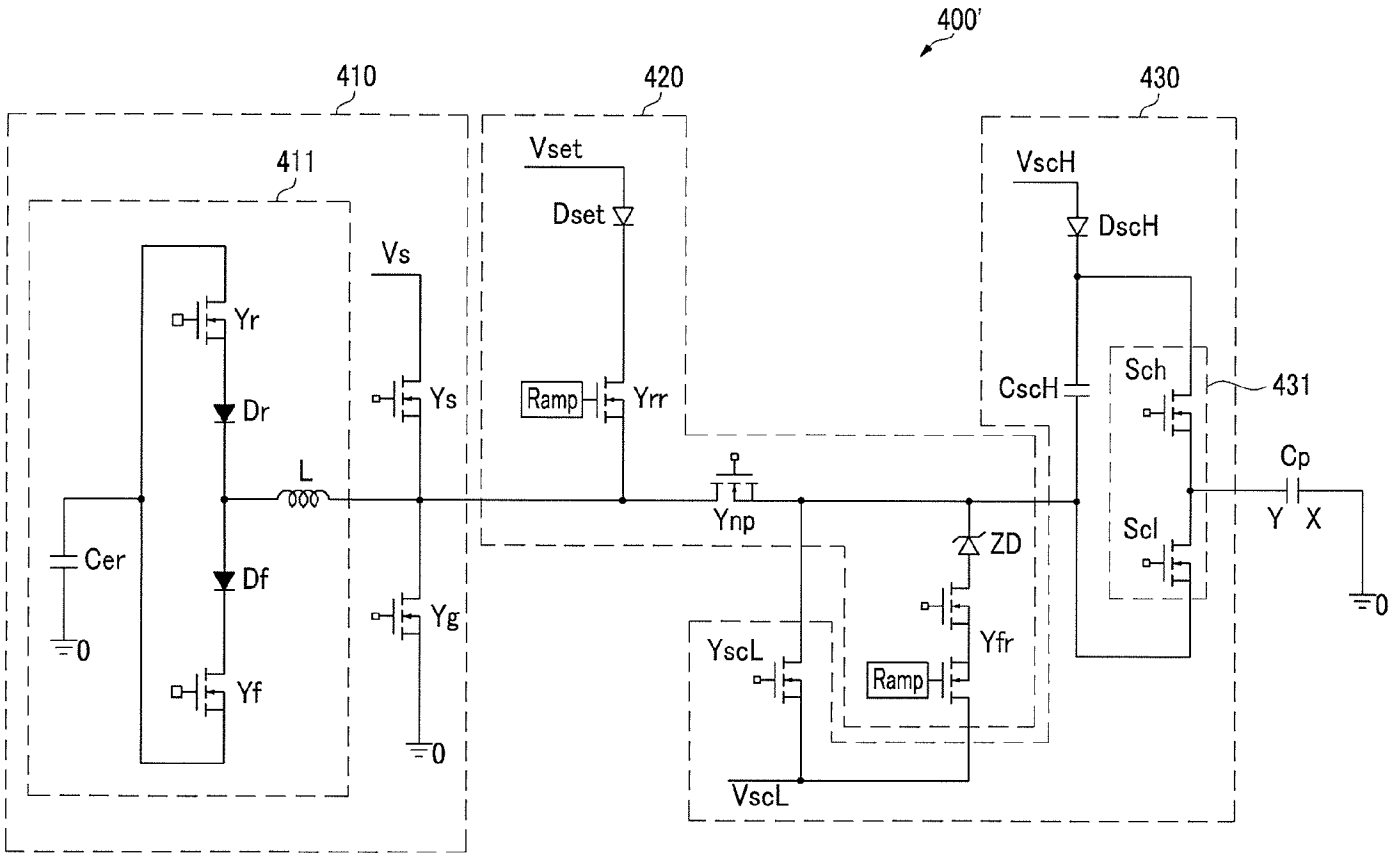
FIG. 1 is a schematic circuit diagram illustrating a driving circuit of a conventional scan electrode driver.
Figure 2:
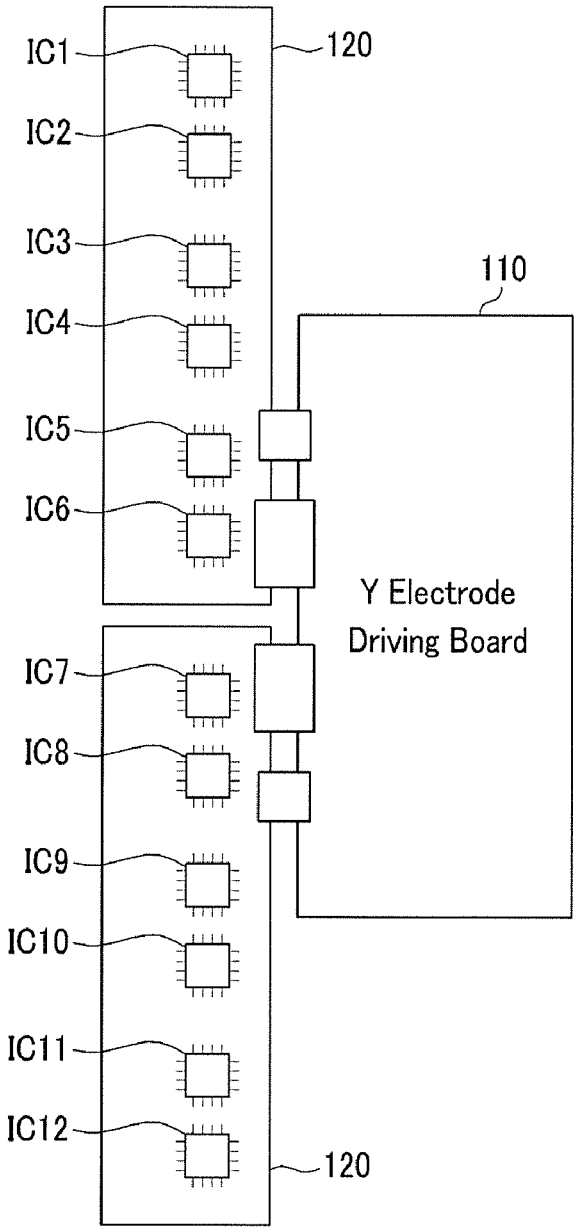
FIG. 2 is a block diagram schematically illustrating a conventional scan electrode driving board and scan boards connected to the scan electrode driving board.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising", will be understood to imply the inclusion of stated elements but not the exclusion of any other elements.

Now, a plasma display device and a driving device thereof according to an exemplary embodiment of the present invention will be described in detail with reference to the drawings.

First, a plasma display device according to an exemplary embodiment of the present invention will be described in detail with reference to FIG. 4.

Figure 4:
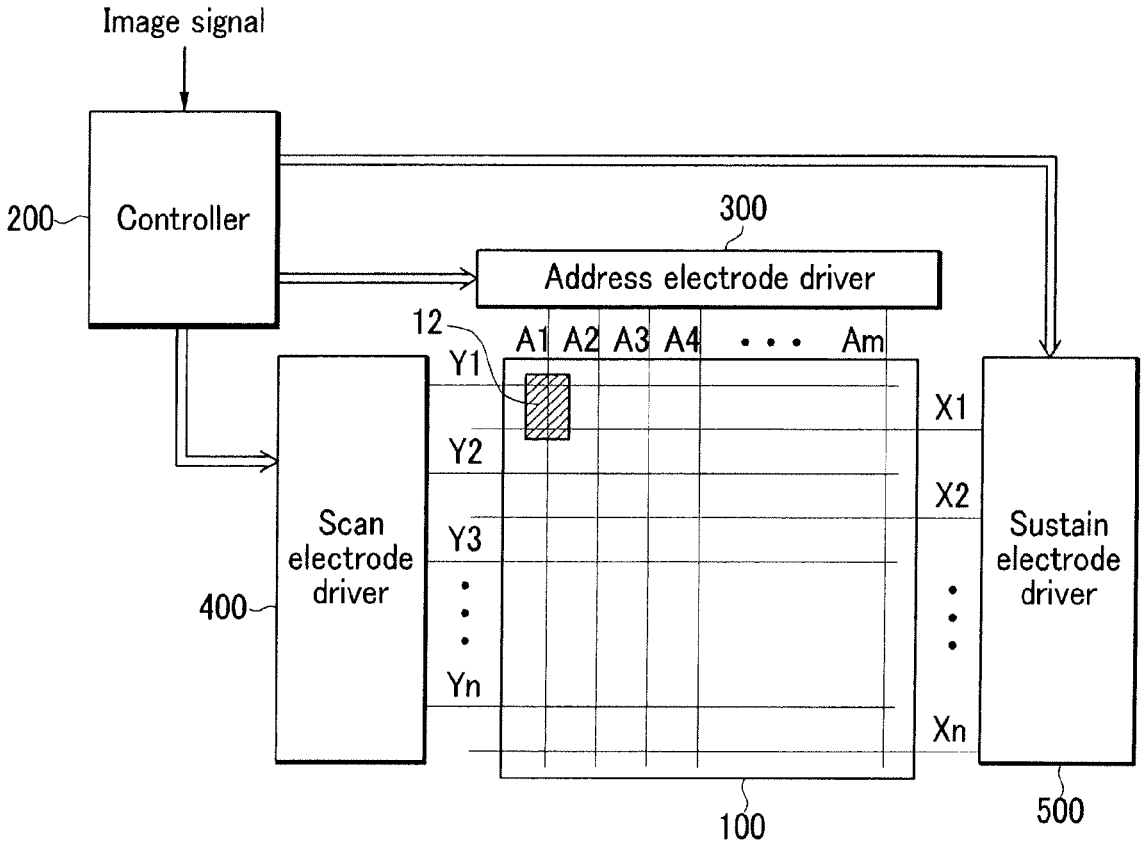
FIG. 4 is a block diagram illustrating a plasma display device according to an exemplary embodiment of the present invention.

FIG. 4 is a block diagram illustrating a plasma display device according to an exemplary embodiment of the present invention.

As shown in FIG. 4, a plasma display device according an exemplary embodiment of the present invention includes a plasma display panel 100, a controller 200, an address electrode driver 300, a scan electrode driver 400, and a sustain electrode driver 500.

The plasma display panel 100 includes a plurality of address electrodes A1 to Am (hereinafter, referred to as "A electrodes") extending in a column direction, and a plurality of sustain electrodes X1 to Xn (hereinafter, referred to as "X electrodes") and scan electrodes Y1 to Yn (hereinafter, referred to as "Y electrodes") extending in a row direction in pairs. In general, the X electrodes X1 to Xn respectively correspond to the Y electrodes Y1 to Yn, and the X electrodes and the Y electrodes perform a display operation for displaying images during a sustain period. Also, the Y electrodes Y1 to Yn and the X electrodes X1 to Xn are perpendicular to the A electrodes A1 to Am. Discharge spaces at crossings of the A electrodes A1 to Am, the X electrodes X1 to Xn, and the Y electrodes Y1 to Yn form discharge cells 12.

The controller 200 receives an external video signal, and then outputs an address electrode driving control signal, a sustain electrode driving control signal, and a scan electrode driving control signal. The controller 200 drives the display on the plasma display panel 100 by dividing each frame into a plurality of subfields. Each subfield includes a reset period, an address period, and a sustain period according to variation in the operation over time.

The address electrode driver 300 receives the A electrode driving control signal from the controller 200 and then applies, to the individual A electrodes, a display data signal for selecting the discharge cells to perform display.

The scan electrode driver 400 receives the Y electrode driving control signal from the controller 200 and then applies a driving voltage to each of the Y electrodes.

The sustain electrode driver 500 receives the X electrode driving control signal from the controller 200 and then applies a driving voltage to each of the X electrodes.

Figure 5:
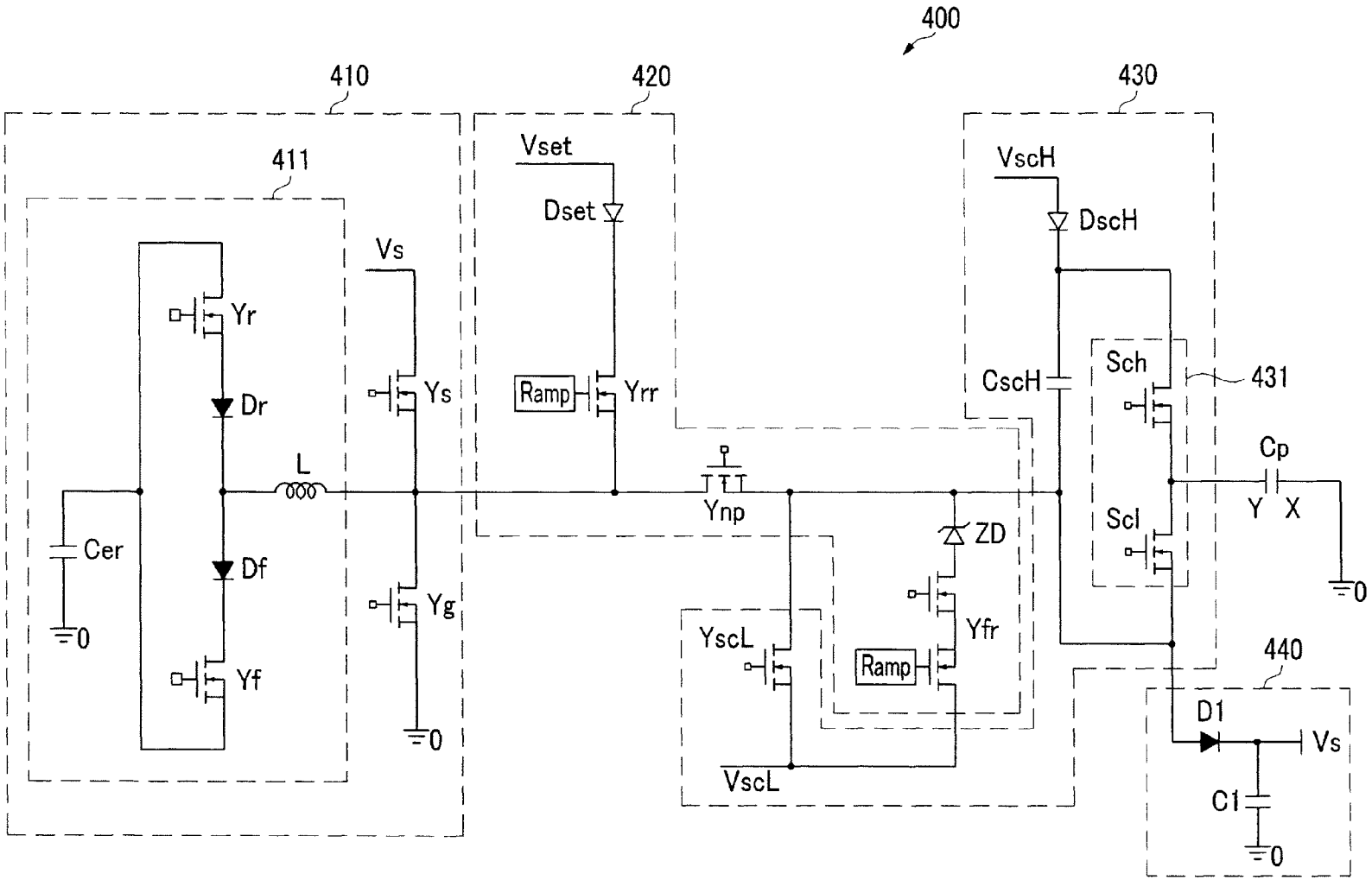
FIG. 5 is a schematic circuit diagram illustrating a driving circuit of a scan electrode driver according to an exemplary embodiment of the present invention.

FIG. 5 is a schematic circuit diagram illustrating a driving circuit of the scan electrode driver according to an exemplary embodiment of the present invention.

In FIG. 5, switches are shown as n-channel field effect transistors (FETs) each having a body diode (not shown). However, other switches having the same or similar function as that of the n-channel FET may be used. Also, each of the capacitive components formed by the respective X electrodes, the Y electrodes, and the A electrodes is shown as a panel capacitor Cp. Therefore, while only one panel capacitor Cp is illustrated in FIG. 5, it represents a plurality of panel capacitors Cp each formed between the corresponding pair of X and Y electrodes. Further, while the sustain electrode X is illustrated as being coupled only to the ground terminal GND for ease of description, the sustain electrode X in the described embodiment is coupled to a circuit similar to that of the scan electrode Y except for a selection circuit 431, such that voltages Vs and 0 V are alternately applied to the scan and sustain electrodes X and Y.

As shown in FIG. 5, the scan electrode driver 400 includes a sustain drive unit 410, a reset drive unit 420, a scan drive unit 430, and a clamping unit 440.

The sustain drive unit 410 includes a power recovery unit 411 and transistors Ys and Yg. In the embodiment shown in FIG. 5, the power recovery unit 411 includes transistors Yr and Yf, an inductor L, diodes Dr and Df, and a capacitor Cer.

The transistor Ys is coupled between a power supply terminal Vs for supplying a Vs voltage and the Y electrode of the panel capacitor Cp, and the transistor Yg is coupled between a ground terminal for supplying a voltage of 0 V and the Y electrode of the panel capacitor Cp. In this case, the Vs voltage is applied to the Y electrode through the transistor Ys and held in the Y electrode, and subsequently the voltage of 0 V is applied to the Y electrode through the transistor Yg and held in the Y electrode. Alternating voltages of 0 V and the Vs voltage having an opposite polarity as those applied to the Y electrodes are applied to the X electrodes. Therefore, in reference to the Y electrodes, voltages of −Vs and Vs are alternately applied between X and Y electrodes that form the panel capacitor Cp.

A first terminal of the capacitor Cer is coupled to a contact point between the transistors Yr and Yf, and the capacitor Cer is charged with a voltage that is half-way between the Vs voltage and 0 V, that is, Vs/2. Further, a first terminal of the inductor L is coupled to the Y electrode, and a second terminal of the inductor L is coupled to a source of the transistor Yr. A drain of the transistor Yr is coupled to the first terminal of the capacitor Cer, a drain of the transistor Yf is coupled to the second terminal of the inductor L, and a source of the transistor Yf is coupled to the first terminal of the capacitor Cer.

Furthermore, a diode Dr is coupled between the source of the transistor Yr and the inductor L, and a diode Df is coupled between the drain of the transistor Yf and the inductor L. The diode Dr sets a rising path to raise the voltage of the panel capacitor Cp when the transistor Yr has a body diode, and the diode Df sets a falling path to drop the voltage of the Y electrode when the transistor Yf has a body diode. In other embodiments, if the transistors Yr and Yf do not have the respective body diodes, the diodes Dr and Df may be not included. The power recovery unit 411 configured as described above increases the voltage of the Y electrode from 0 V to the Vs voltage or decreases the voltage of the Y electrode from the Vs voltage to 0 V using the resonance of the inductor L and the panel capacitor Cp.

In other embodiments, in the power recovery unit 411, the order in which the inductor L, the diode Df, and the transistor Yf are coupled may be changed, and the order in which the inductor L, the diode Dr, and the transistor Yr are coupled may also be changed. For example, the inductor L may be coupled between the contact point of the transistors Yr and Yf and the capacitor Cer for power recovery. Also, in FIG. 5, the inductor L is coupled to the contact point between the transistors Yr and Yf. However, in other embodiments, separate inductors L may be respectively coupled on the rising path formed by the transistor Yr and the falling path formed by the transistor Yf.

The reset drive unit 420 includes transistors Yrr, Yfr, and Ynp, a Zener diode ZD, and a diode Dset, and gradually increases the voltage of the Y electrode from a VscH voltage to a VscH+Vset voltage in a rising period of the reset period. Also, the reset drive unit 420 gradually decreases the voltage of the Y electrode from the VscH voltage to a Vnf voltage in a falling period of the reset period. Here, the absolute value of the Vset voltage is smaller than that of the high-level voltage Vs of the sustain pulse to be applied during the subsequent sustain period.

A source of the transistor Yrr having a drain coupled to a power supply Vset is electrically coupled to the Y electrode, and the source of the transistor Ynp whose drain is coupled to the source of the transistor Yrr is coupled to the Y electrode. Also, in order to block a current caused by a body diode of the transistor Yrr, the diode Dset is coupled in the opposite direction as the body diode of the transistor Yrr.

The transistor Yfr is coupled between a power supply VscL for supplying a VscL voltage and the Y electrode of the panel capacitor Cp, and the Zener diode ZD is coupled between the transistor Yfr and the Y electrode, since a Vnf voltage is formed higher than a scan voltage (VscL voltage). Here, it is assumed that the Vnf voltage is higher than the VscL voltage by a breakdown voltage of the Zener diode ZD. In other embodiments, the Zener diode ZD may be coupled between the power supply VscL and the transistor Yfr. Also, since the Vnf voltage is formed higher than the VscL voltage, when the transistor YscL is turned on, a current path may be formed through a body diode of the transistor Yfr. Therefore, in order to cut the current path through the body diode of the transistor Yfr, the transistor Yfr may be formed to have a back-to-back configuration.

The scan drive unit 430 includes a selection circuit 431, a capacitor CscH, a diode DscH, and a transistor YscL, applies the scan voltage (VscL voltage) to the Y electrodes during the address period in order to select the turn-on discharge cells and applies a non-scan voltage (VscH voltage) to the Y electrodes of the turn-off discharge cells. Generally, in order to sequentially select the plurality of Y electrodes Y1 to Yn, the selection circuits 431 are coupled in the form of ICs to the individual Y electrodes Y1 to Yn, and a common driving circuit of the scan electrode driver 400 is coupled to the Y electrodes Y1 to Yn through the selection circuits 431. FIG. 5 illustrates only the selection circuit 431 coupled to one Y electrode.

The selection circuit 431 includes transistors Sch and Scl. A source of the transistor Sch and a drain of the transistor Scl are coupled to the Y electrode of the panel capacitor Cp. A first terminal of the capacitor CscH is coupled to a source of the transistor Scl and a second terminal of the capacitor CscH is coupled to a drain of the transistor Sch. Also, the transistor YscL is coupled to the power supply VscL and the Y electrode of the panel capacitor Cp, and a cathode of the diode DscH whose anode is coupled to the power supply Vsch for supplying the non-scan voltage (VscH voltage) is coupled to the drain of the transistor Sch. Here, when the transistor YscL is turned on, the capacitor CscH is charged with a voltage of VscH-VscL.

In the embodiment illustrated in FIG. 5, each of the transistors Ys, Yg, Yr, Yf, Yrr, YscL, Sch, Scl, and Ynp is composed of one transistor. However, in other embodiments, each of the transistors Ys, Yg, Yr, Yf, Yrr, YscL, Sch, Sdl, and Ynp may be composed of a plurality of transistors coupled in parallel.

The clamping unit 440 includes a clamping diode D1 and a capacitor C1. More specifically, the clamping diode D1 is coupled to an input terminal of the transistor Scl of the selection circuit 431 and clamps or prevents overshoot generated when the sustain pulse output from the sustain drive unit 410 is applied to each panel capacitor Cp. Further, the capacitor C1 has been charged with the Vs voltage and thus the clamping unit 440 more stably clamps the high-level voltage Vs of the sustain pulse. At this time, the anode of the clamping diode D1 is coupled to the source of the transistor Scl, and the cathode thereof is coupled to a power supply terminal Vs. Further, one end of the capacitor C1 is coupled between the cathode of the clamping diode D1 and the power supply terminal Vs.

FIG. 5 shows the clamping unit 440 coupled to one selection circuit 431 (IC). However, in the exemplary embodiment of the present invention, this means that the clamping unit 440 is coupled to at least one of the input terminals of the switches Scl of the plurality of selection circuits 431 (IC (IC1 to IC12)). For example, larger overshoot is generated in one of the plurality of selection circuits 431 (IC (IC1 to IC12)) that is further from the sustain drive unit 410. Therefore, when the clamping unit 440 is coupled to the input terminals (sources) of the transistors Scl of the selection circuits 431 (implemented in IC (IC1 and IC12)), it is possible to more effectively reduce or prevent the overshoot.

Hereinafter, a method of generating a sustain pulse according to an exemplary embodiment of the present invention will be described with reference to FIGS. 6A to 6D.

FIGS. 6A to 6D are schematic circuit diagrams each illustrating a current path of a sustain pulse applied to a scan electrode in a sustain period.

Figure 6A:
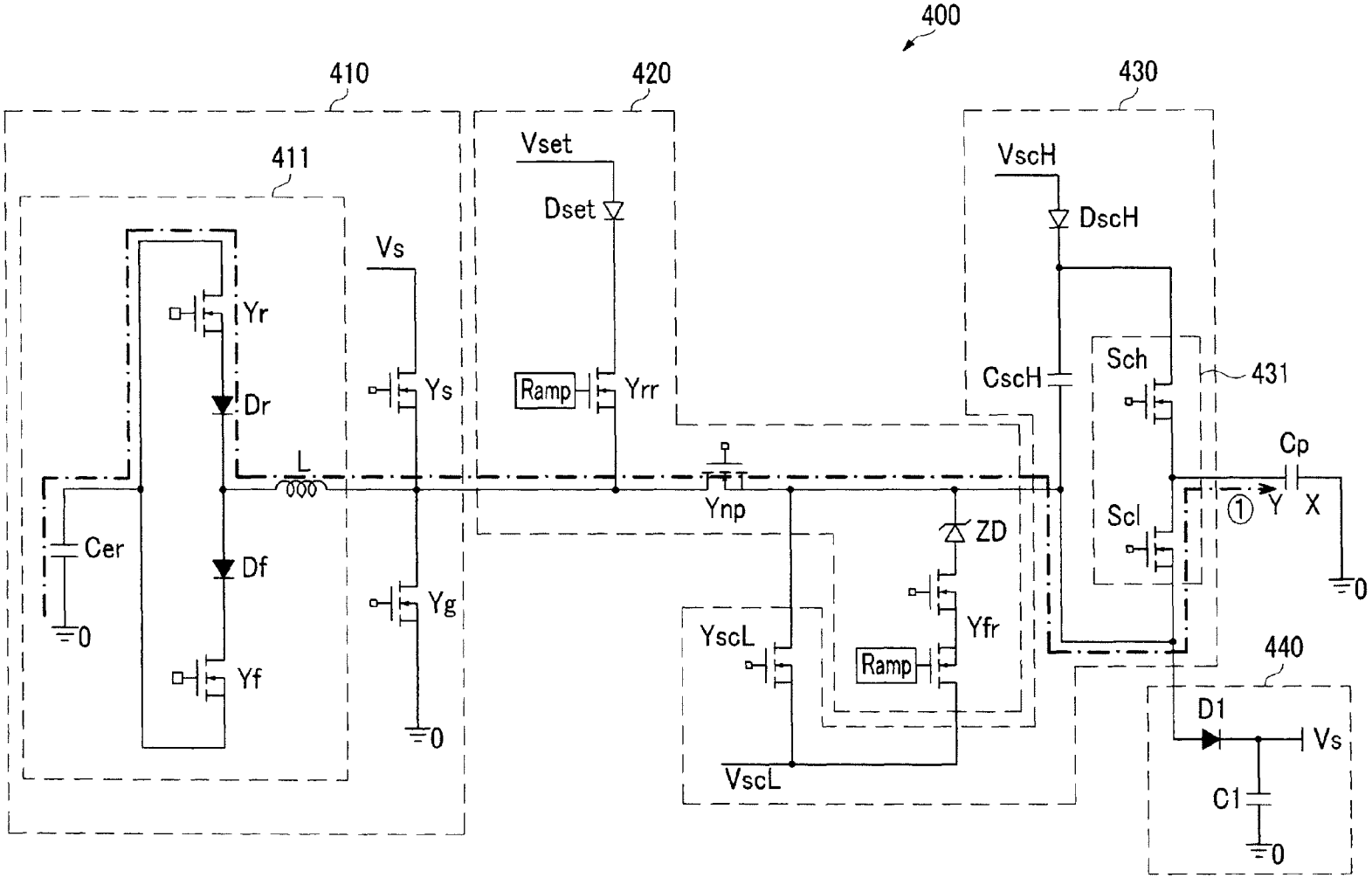
FIGS. 6A to 6D are schematic circuit diagrams illustrating the current paths of sustain pulses applied to scan electrodes in a sustain period.

It is assumed that the capacitor Cer is charged with the voltage Vs/2 before a first mode M1 shown in FIG. 6A starts.

(1) First Mode—see FIG. 6A

In the first mode, the transistors Yr and Ynp are turned on. Then, as shown in FIG. 6A, a current path ① from the capacitor Cer to the panel capacitor Cp through the transistor Yr, the diode Dr, the inductor L, the transistor Ynp, and the transistor Scl is formed and thus resonance is generated between the inductor L and the panel capacitor Cp. The resonance causes the panel capacitor Cp to be charged, and thus the voltage of the scan electrode Y of the panel capacitor Cp gradually increases from 0 V to a voltage close to the Vs voltage. Then, the current flowing through the inductor L linearly increases with a slope of V/L and then linearly decreases with a slope of −(Vs−V)/L, where V is a voltage charged in the capacitor Cp.

Figure 6B:
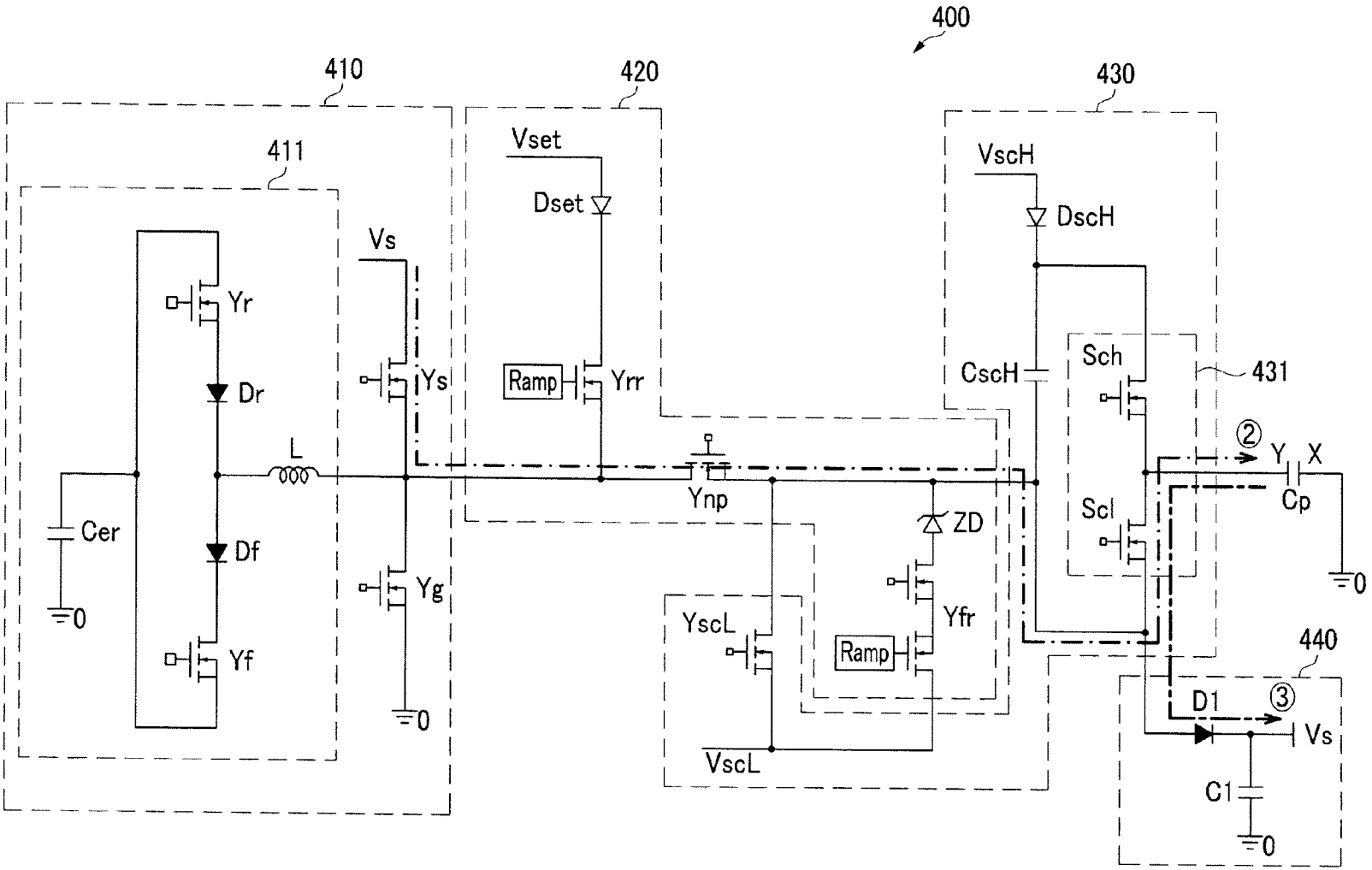

(2) Second Mode—see FIG. 6B

In a second mode, when the current flowing through the inductor L decreases to 0 A, the transistor Yr is turned off. Then, the transistor Ys is turned on, and thus a current path ② from the power supply terminal Vs to the panel capacitor Cp through the transistor Ys, the transistor Ynp, and the transistor Scl is formed. As a result, the high-level voltage Vs is applied to the scan electrode Y and held in the scan electrode Y.

Figure 3:
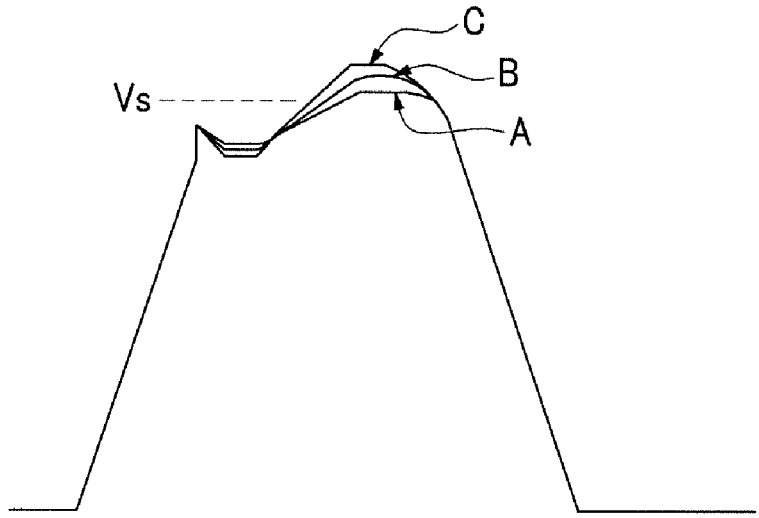
FIG. 3 is a diagram schematically illustrating sustain pulses applied to scan electrodes by the scan electrode driver shown in FIG. 1.

During the sustain period, when the high-level voltage Vs is applied to the scan electrode, overshoot may occur as shown in FIG. 3. For this reason, in an exemplary embodiment of the present invention, the clamping unit 440 is coupled to the input terminal (source) of the transistor Scl. That is, when the transistor Ys is turned on and overshoot occurs to cause an overvoltage higher than the high-level voltage Vs to be applied to the panel capacitor Cp, the clamping diode D1 of the clamping unit 440 is turned on. Then, as shown in FIG. 6B, the overvoltage is clamped through a path ③ from the panel capacitor Cp to the power supply terminal Vs through the transistor Scl and the clamping diode D1.

Figure 6C:
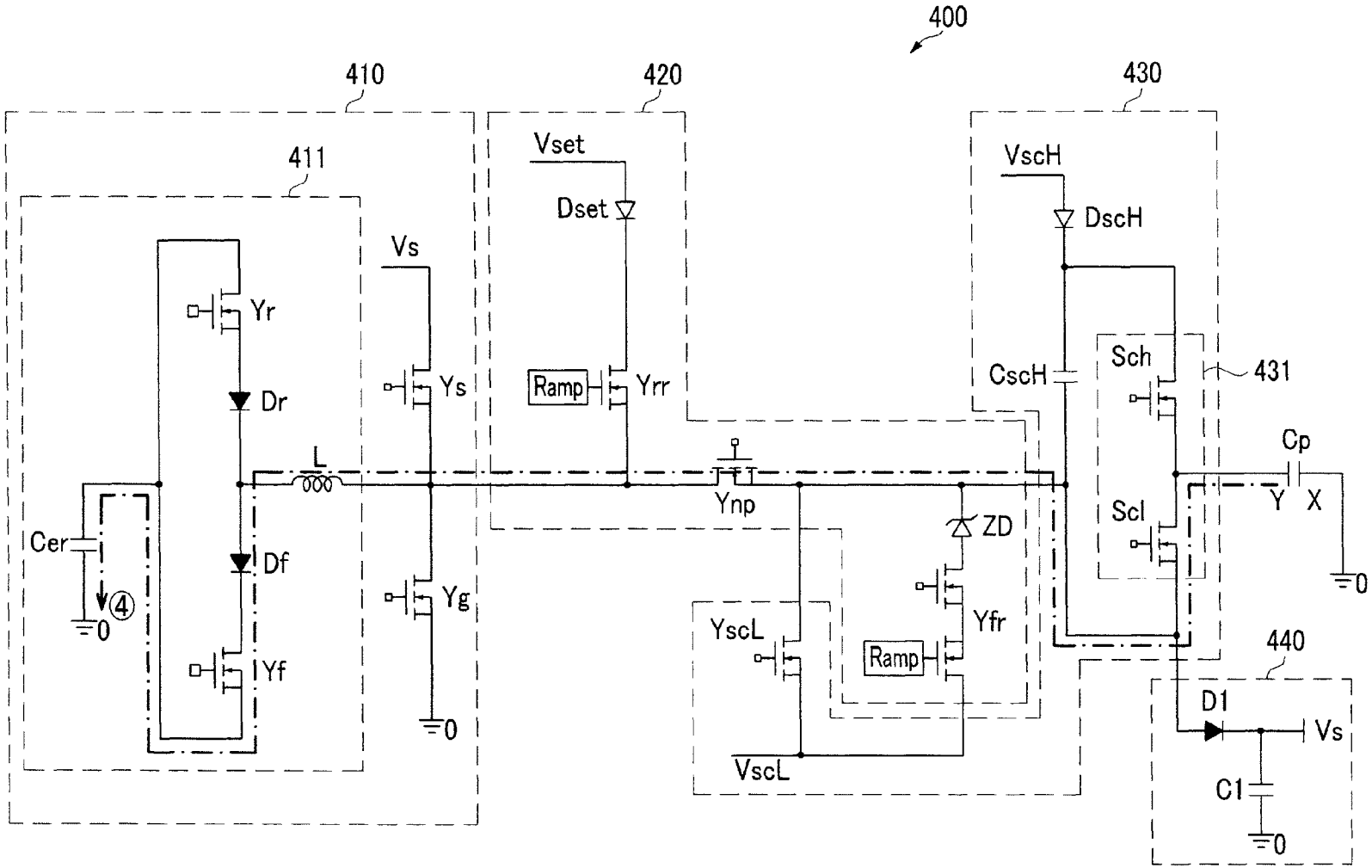

(3) Third Mode—see FIG. 6C

In a third mode, the transistor Ys is turned off and the transistor Yf is turned on. Then, as shown in FIG. 6C, a current path ④ from the panel capacitor Cp to the capacitor Cer through the transistor Scl, the transistor Ynp, the inductor L, and the transistor Yf is formed and thus resonance occurs between an inductor L and the panel capacitor Cp. The resonance causes the voltage of the scan electrode Y of the panel capacitor Cp to gradually decrease to the low-level voltage (0 V). That is, the panel capacitor Cp is discharged. Also, in the third mode, the current flowing through the inductor L linearly decreases with a slope of −(Vs−V)/L and thus increases with a slope of V/L, where V is a voltage charged in the capacitor Cp.

Figure 6D:
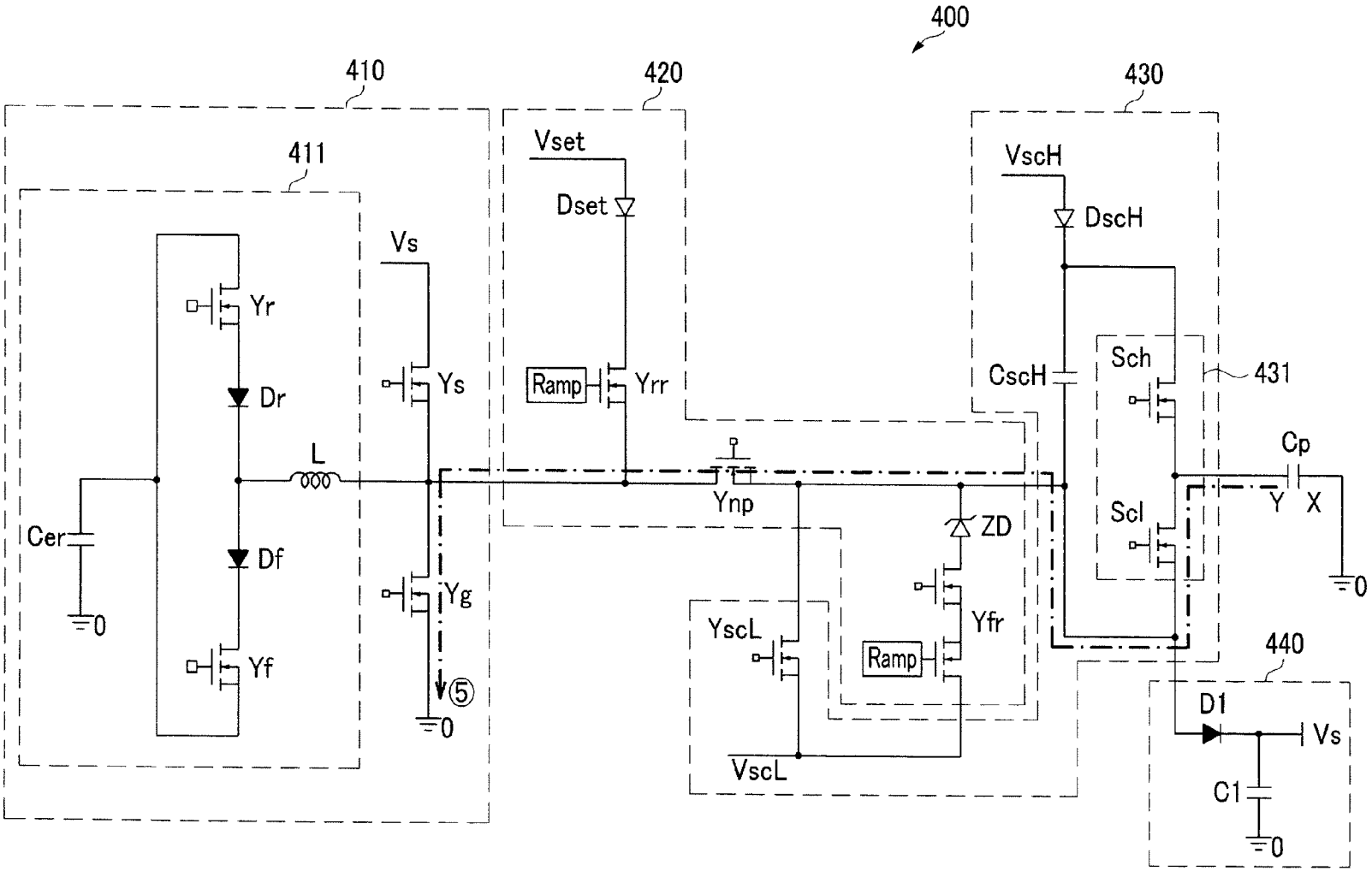

(4) Fourth Mode—see FIG. 6D

After the third mode, when the current $I_L$ flowing through the inductor L becomes 0 A, in a fourth mode, the transistor Yf is turned off and the transistor Yg is turned on. Then, as shown in FIG. 6D, a current path ⑤ from the panel capacitor Cp to the ground terminal (0 V) through the transistor Scl, the transistor Ynp, and the transistor Yg is formed. Therefore, the low-level voltage (0 V) is applied to the scan electrode Y and held in the scan electrode Y.

After the fourth mode finishes, the scan electrode driver 400 repeats the operations during the subsequent first to fourth modes.

As described above, in the scan electrode driver 400 according to the exemplary embodiment of the present invention, since the clamping unit 440 is coupled to both the output terminal of the sustain drive unit 410 and the input terminal of the selection circuit 431 (IC) and reduces or prevents wave distortion, such as overshoot, from occurring, it is possible to apply a stable sustain pulse to all of the discharge cells.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

According to the exemplary embodiment of the present invention, it is possible to reduce or prevent overshoot when the Vs voltage is applied to the Y electrode so as to apply a stable sustain pulse. Also, it is possible to effectively clamp overshoot whose magnitude depends on the distance between the scan driving board and each of the plurality of selecting circuits IC so as to apply a stable pulse to all of the discharge cells.

What is claimed is:

1. A plasma display device having a plurality of first electrodes and a plurality of second electrodes for performing a display operation together with the plurality of first electrodes, the plurality of first electrodes and the plurality of second electrodes corresponding to a plurality of discharge cells defined in the plasma display device, the device comprising:

a scan drive unit comprising a plurality of selection circuits each having a first switch and a second switch, the selection circuits being adapted to sequentially apply a scan voltage to some of the plurality of first electrodes through the first switches, and to apply a non-scan voltage to others of the plurality of first electrodes through the second switches;

a sustain drive unit for applying a sustain pulse alternately having a first voltage and a second voltage lower than the first voltage to the plurality of first electrodes through the plurality of selection circuits; and a clamping unit coupled to at least one of the plurality of selection circuits and for clamping a voltage of a corresponding one of the plurality of first electrodes at the first voltage when the voltage of the corresponding one of the plurality of first electrodes exceeds the first voltage, wherein the clamping unit comprises a clamping diode having an anode directly coupled to an input terminal of the first switch and a cathode coupled to a first power supply for supplying the first voltage, such that the clamping diode is located between the input terminal and the first power supply, and the clamping unit further comprises a capacitor coupled at a connection point between the cathode of the clamping diode and the first power supply, wherein the capacitor is serially coupled to the diode between the input terminal of the first switch and a third voltage source.

2. The plasma display device of claim 1, wherein the clamping unit is coupled to one selection circuit among the plurality of selection circuits, the one selection circuit being furthest from an output terminal of the sustain drive unit.

3. A plasma display device comprising:

a plurality of first electrodes corresponding to a plurality of discharge cells defined in the plasma display device;

a first switch electrically coupled between the plurality of first electrodes and a first power supply for supplying a first voltage so as to form a path for applying the first voltage to the plurality of first electrodes;

a second switch electrically coupled between the plurality of first electrodes and a second power supply for supplying a second voltage lower than the first voltage so as to form a path for applying the second voltage to the plurality of first electrodes;

a plurality of third switches having input terminals electrically coupled to a contact point between the first and second switches and output terminals coupled to the plurality of first electrodes;

a clamping diode having an anode directly coupled to the input terminal of at least one of the plurality of third switches and a cathode coupled to the first power supply, such that the clamping diode is located between the input terminal and the first power supply; and a capacitor having a first terminal coupled to a connection point between the cathode of the clamping diode and the first power supply and a second terminal coupled to a ground terminal, wherein the capacitor is serially coupled to the clamping diode between an input terminal of the first switch and a third voltage source, wherein the first capacitor is configured to be charged with the first voltage, and wherein the first and second voltages are applied to the plurality of first electrodes through the plurality of third switches.

4. The plasma display device of claim 3, wherein said at least one of the plurality of third switches coupled to the anode of the clamping diode, is located furthest from the first and second switches among the plurality of third switches.

5. The plasma display device of claim 3, wherein the first voltage is a high-level voltage of a sustain pulse applied to the plurality of first electrodes.

6. The plasma display device of claim 3, wherein the third switches form paths for applying a scan voltage to the first electrodes of the discharge cells to be selected as turn-on discharge cells during an address period.

7. A method of driving a plasma display device during a frame having a plurality of subfields each comprising a reset period, an address period and a sustain period, the plasma display device comprising a plurality of first electrodes, a plurality of second electrodes crossing the plurality of first electrodes, and a scan drive unit for sequentially applying a scan voltage to the plurality of first electrodes, the plurality of first electrodes and the plurality of second electrodes corresponding to a plurality of discharge cells defined in the plasma display device, the method comprising:

sequentially applying the scan voltage to the plurality of first electrodes using the scan drive unit and applying an address voltage to the second electrodes corresponding to turn-on discharge cells among the plurality of discharge cells to which the scan voltage is applied in the address period so as to select the turn-on discharge cells; and applying a sustain pulse having a first voltage and a second voltage lower than the first voltage to the plurality of first electrodes using the scan drive unit in the sustain period so as to cause sustain discharge in the turn-on discharge cells, wherein, in the sustain period, when an overvoltage is applied to at least one of the plurality of first electrodes, a voltage of the at least one of the plurality of first electrodes is clamped at the first voltage by a clamping unit that is coupled to at least one selection circuit of the scan drive unit and coupled to the at least one of the plurality of first electrodes through the at least one selection circuit, wherein the clamping unit comprises a clamping diode having an anode directly coupled to an input terminal of the at least one selection circuit and a cathode coupled to a first power supply for supplying the first voltage, such that the clamping diode is located between the input terminal and the first power supply, and the clamping unit further comprises a capacitor coupled at a connection point between the cathode of the clamping diode and the first power supply, wherein the capacitor is serially coupled to the diode between the input terminal of a first switch and a third voltage source.

8. The method of claim 7, wherein the at least one selection circuit includes a plurality of first switches for forming paths for applying the scan voltage to some of the plurality of first electrodes and a plurality of second switches for forming paths for applying a non-scan voltage to others of the plurality of first electrodes, and the sustain pulse is applied to said some of the plurality of first electrodes through the first switches in the sustain period.

9. The method of claim 8, further comprising, in a reset period before the address period, initializing the plurality of discharge cells by gradually raising the voltages of the plurality of first electrodes and then gradually dropping the voltages of the plurality of first electrodes through the second switches.

10. A plasma display device for displaying an image corresponding to a video signal, the plasma display device comprising:

a plasma display panel having a plurality of discharge cells, a plurality of scan electrodes, a plurality of sustain electrodes arranged in parallel with the plurality of scan electrodes and forming a panel capacitor with the plurality of scan electrodes, and a plurality of address electrodes crossing the scan electrodes and the sustain electrodes, the discharge cells corresponding to the scan electrodes, the sustain electrodes and the address electrodes;

a sustain electrode driver for providing a sustain electrode driving voltage to the plurality of sustain electrodes in response to a sustain electrode driving control signal;

an address electrode driver for providing an address electrode driving voltage to the plurality of address electrodes in response to an address electrode driving control signal;

a scan electrode driver comprising:

a reset drive unit for providing a reset signal to the plurality of scan electrodes;

a sustain drive unit for providing a scan electrode driving voltage to the plurality of scan electrodes in response to a scan electrode driving control signal, the scan electrode driving voltage alternately having a first voltage and a second voltage lower than the first voltage;

a scan drive unit coupled to the reset drive unit and the sustain drive unit, the scan drive unit for receiving a reset signal and the scan electrode driving voltage and providing the reset signal and the scan electrode driving voltage to the plurality of scan electrodes; and a clamping unit comprising a diode having an anode directly coupled to the scan drive unit for clamping a voltage of a corresponding one of the plurality of scan electrodes at the first voltage when the voltage of the corresponding one of the plurality of scan electrodes exceeds the first voltage and a cathode coupled to a power source for providing the first voltage, and the clamping unit further comprising a capacitor coupled at a connection point between the cathode of the clamping diode and the first power supply, wherein the capacitor is serially coupled to the diode between the input terminal of the first switch and a third voltage source; and a controller for receiving the video signal, generating the driving control signals using the video signal, and providing the driving control signals to the sustain electrode driver, the address electrode driver and the scan electrode driver.

11. The plasma display device of claim 10, wherein the scan drive unit comprises at least one selection circuit coupled to the clamping unit, wherein the clamping unit clamps the voltage applied to the corresponding one of the plurality of scan electrodes through the at least one selection circuit.

12. The plasma display device of claim 10, wherein the sustain drive unit comprises a first transistor coupled between a first voltage source for providing the first voltage and the scan electrodes and a second transistor coupled between a second voltage source for providing the second voltage and the scan electrodes.

13. The plasma display device of claim 10, wherein the image is displayed during a frame comprising a plurality of subfields, wherein each of the subfields comprises a reset period, an address period and a sustain period, and wherein the reset drive unit provides the reset signal during the reset period, and the sustain drive unit provides the scan electrode driving voltage during the sustain period.

* * * * *